US010820124B2

(12) United States Patent
Higgins et al.

(10) Patent No.: US 10,820,124 B2
(45) Date of Patent: Oct. 27, 2020

(54) SUSPENSION ASSEMBLY FOR HEARING AID RECEIVER

(71) Applicant: Starkey Laboratories, Inc., Eden Prairie, MN (US)

(72) Inventors: Sidney A. Higgins, Maple Grove, MN (US); Brian Dobson, Maple Grove, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 16/018,771

(22) Filed: Jun. 26, 2018

(65) Prior Publication Data

US 2018/0376260 A1 Dec. 27, 2018

Related U.S. Application Data

(63) Continuation of application No. 15/274,685, filed on Sep. 23, 2016, now Pat. No. 10,021,493.

(60) Provisional application No. 62/233,232, filed on Sep. 25, 2015.

(51) Int. Cl.
*H04R 25/00* (2006.01)

(52) U.S. Cl.
CPC ..... *H04R 25/60* (2013.01); *H04R 25/658* (2013.01); *H04R 2225/021* (2013.01)

(58) Field of Classification Search
CPC ..... H04R 25/456; H04R 25/604
See application file for complete search history.

(56) References Cited

U.S. PATENT DOCUMENTS 3,118,023 A * 1/1964 Victoreen ..... H04R 25/604 381/322
3,172,963 A * 3/1965 Victoreen ..... G02C 11/06 381/322
3,257,516 A * 6/1966 Knowles ..... H04R 25/604 381/345
3,534,183 A * 10/1970 Knowles ..... H04R 1/225 381/368
4,620,605 A * 11/1986 Gore ..... H04R 25/604 181/130

(Continued)

FOREIGN PATENT DOCUMENTS

EP 1450579 A1 * 8/2004 ..... H04R 25/456
GB 2096863 A * 10/1982 ..... H04R 25/604
WO WO-2011107205 A1 9/2011

OTHER PUBLICATIONS

"U.S. Appl. No. 15/274,685, Non Final Office Action dated Aug. 9, 2017", 14 pgs.

(Continued)

*Primary Examiner* — Fan S Tsang
*Assistant Examiner* — Ryan Robinson
(74) *Attorney, Agent, or Firm* — Schwegman Lundberg & Woessner, P.A.

(57) ABSTRACT

A suspension assembly for a hearing aid receiver is described in which the receiver is contained within a receiver can. A cover assembly may be provided for covering the open top end of the receiver can and for containing the receiver's spout when the receiver is mounted within the receiver can. To dampen or reduce the transmission of receiver vibrations within the receiver can, a spout seal and corner bumpers may also be provided.

20 Claims, 6 Drawing Sheets

(56) References Cited

U.S. PATENT DOCUMENTS

| | | | | |
|---|---|---|---|---|
| 4,854,415 | A * | 8/1989 | Goschke | H04R 25/60 181/130 |
| 6,459,800 | B1 * | 10/2002 | Brimhall | H04R 25/604 181/171 |
| 6,625,290 | B1 | 9/2003 | Dittli | |
| 6,751,326 | B2 | 6/2004 | Nepomuceno | |
| 7,076,074 | B2 | 7/2006 | Gebert et al. | |
| 7,206,428 | B2 * | 4/2007 | Geschiere | H04R 25/604 381/324 |
| 8,693,718 | B2 * | 4/2014 | Agustiar | H04R 25/604 381/322 |
| 9,002,047 | B2 | 4/2015 | Lin et al. | |
| 9,055,366 | B2 * | 6/2015 | Azmi | H04R 1/1075 |
| 9,071,918 | B2 * | 6/2015 | Higgins | H04R 25/60 |
| 9,578,429 | B2 | 2/2017 | Karamuk | |
| 10,021,493 | B2 | 7/2018 | Higgins et al. | |
| 10,051,383 | B2 * | 8/2018 | Margot | H04R 25/456 |
| 2009/0304216 | A1 * | 12/2009 | Hansen | H04R 25/604 381/324 |
| 2015/0110328 | A1 | 4/2015 | Sondergaard | |
| 2015/0201293 | A1 * | 7/2015 | Sanecki | H04R 25/60 381/55 |
| 2017/0094422 | A1 | 3/2017 | Margot | |
| 2017/0094427 | A1 | 3/2017 | Higgins et al. | |
| 2017/0118567 | A1 * | 4/2017 | Larssen | H04R 25/654 |

OTHER PUBLICATIONS

"U.S. Appl. No. 15/274,685, Notice of Allowance dated Mar. 13, 2018", 8 pgs.
"U.S. Appl. No. 15/274,685, Response filed Nov. 9, 2017 to Non Final Office Action dated Aug. 9, 2017", 6 pgs.

* cited by examiner

SUSPENSION ASSEMBLY FOR HEARING AID RECEIVER

CROSS-REFERENCE TO RELATED APPLICATION

This patent application is a continuation of U.S. patent application Ser. No. 15/274,685, filed Sep. 23, 2016, issued as U.S. Pat. No. 10,021,493, which application claims the benefit of U.S. Provisional Patent Application No. 62/233,232, filed Sep. 25, 2015, entitled "Suspension Assembly for Hearing Aid Receiver", each of which are incorporated by reference herein in their entirety.

FIELD OF THE INVENTION

This invention pertains to electronic hearing aids and methods for their construction.

BACKGROUND

Hearing aids are electroacoustic device which amplify sound for the wearer in order to correct hearing deficits. Certain types of hearing aids, referred to as behind-the-ear (BTE) hearing aids, utilize a housing that is worn behind the ear that contains, among other things, a receiver (e.g, loudspeaker) that conducts sound to an ea bud inside the ear via an audio tube. The receiver is an electro-acoustic transducer that converts electrical signals to acoustic signals and is a source of magnetic radiation that may affect other components inside the housing such as the processing circuitry or a telecoil used to receive audio signals from a magnetic source such as a telephone. The generation of an acoustic signal by the receiver also causes the receiver to vibrate which can affect the overall performance of the hearing aid. For example, the vibrations in the receiver can be transmitted back to the microphone, causing unwanted feedback.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

Figure 1:
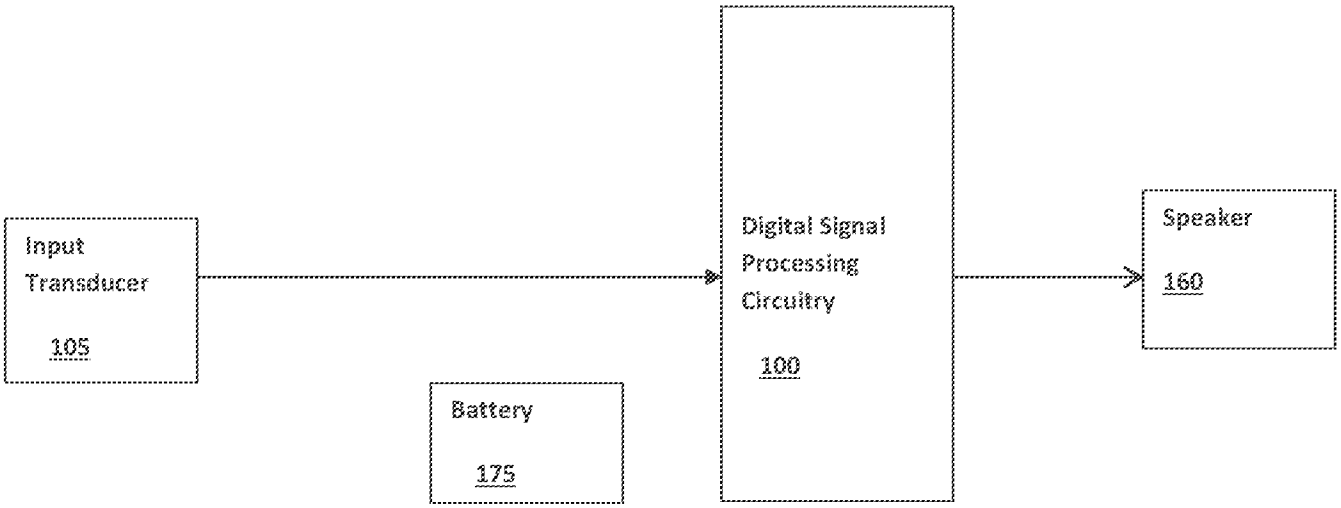
FIG. 1 shows the basic electronic components of an example hearing aid.

FIG. 1 illustrates the basic functional components of an example hearing aid. Hearing aids are devices that compensate for hearing losses by amplifying sound whose electronic components include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. The electronic circuitry of the hearing aid is contained within a housing that may be placed, for example, in the external ear canal or behind the ear. An input transducer (i.e., microphone) 105 receives sound waves from the environment and converts the sound into an input signal. After amplification by a pre-amplifier, the input signal is sampled and digitized to result in a digitized input signal that is passed to processor 100. The processor 100 processes the digitized input signal into an output signal in a manner that compensates for the patient's hearing deficit (e.g., frequency-specific amplification and compression). The output signal is then converted to analog form and passed to an audio amplifier that drives a receiver 160 (a.k.a. a loudspeaker) to convert the output signal into an audio output. A battery 175 supplies power for the electronic components. In a BTE hearing aid, the receiver 160 may be contained in the housing worn behind the ear. An acoustic path is provided for sound produced by receiver that may include an audio tube connected to an earbud placed in the wearer's ear.

Figure 2:
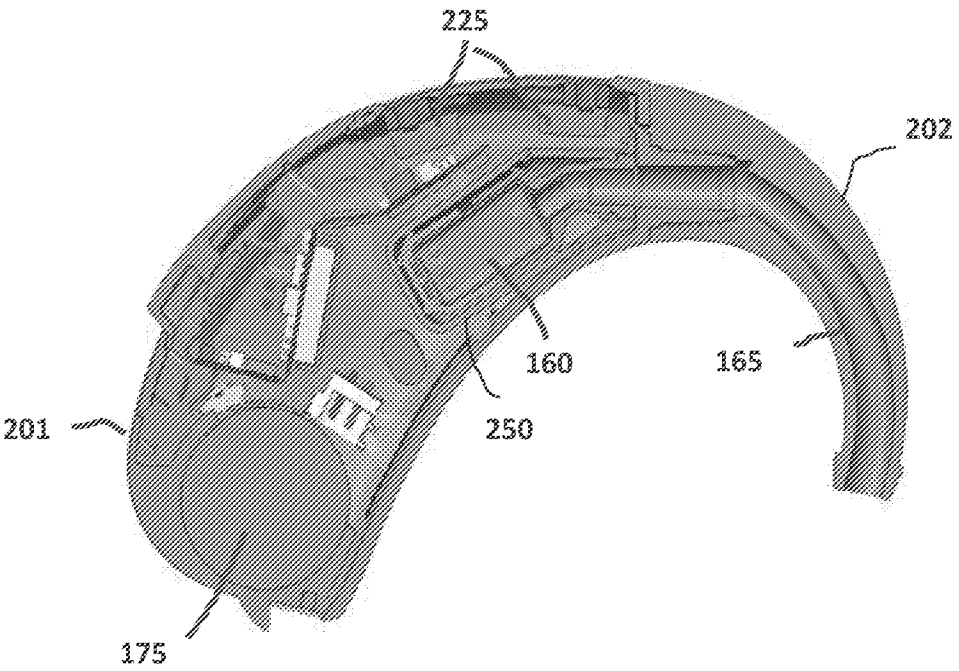
FIG. 2 shows an embodiment of a BTE hearing aid in cross-section.

FIG. 2 shows an embodiment of a BTE hearing aid in cross-section that includes a housing 201 that contains a battery 175, a receiver 160, a pair of omnidirectional microphones 225, and an audio tube 165 connected to the device housing for providing an acoustic path from the receiver. The audio tube 165 extends within an ear hook 202 of the housing 201. To reduce the magnetic radiation produced by the receiver, the receiver may be contained within a separate housing, referred to as a receiver can, that provides magnetic shielding. Such a receiver can 250 is illustrated in FIG. 2.

To dampen or reduce the transmission of receiver vibrations within the receiver can, a receiver suspension assembly may be provided. Described herein are embodiments for receiver suspensions that may be used alone or in any combination. Previous designs for receiver suspensions are bulky and difficult to align without biasing the receiver and usually must be developed differently for any specific receiver. The embodiments described below may be implemented to provide modular manufacture, size reduction, consistency (performance & acoustic seal), and uniformity (one size fits all)

Figure 3A:
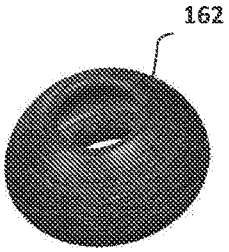
FIGS. 3A through 3C illustrate the use of a spout suspension seal.
Figure 3B:
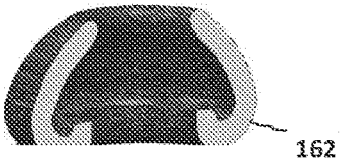

In one embodiment, the receiver 160 has top and bottom ends with a spout 161 extending from the top end for conducting sound generated by the receiver. The receiver can 250 has top and bottom ends with the top end being open to allow insertion of the receiver therein. FIGS. 3A through 3B illustrate the use of a spout suspension seal 162 in one embodiment that surrounds the spout 161 and absorbs shocks when the spout vibrates.

Figure 4A:
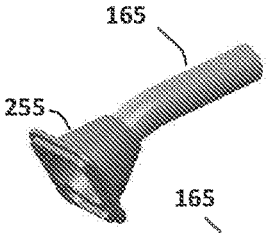
FIGS. 4A through 4C illustrate the use of a cover assembly.
Figure 4B:
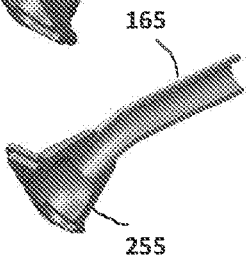
Figure 4C:
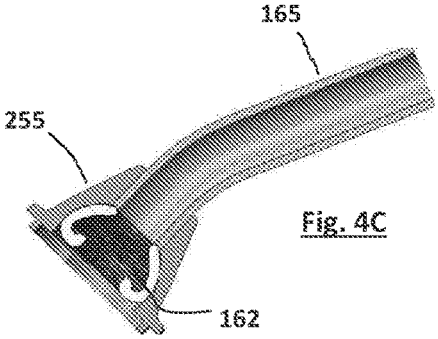

FIGS. 4A through 4C illustrate the use of a cover assembly 255 in one embodiment where the cover assembly 255 covers the open top end of the receiver can and contains the receiver's spout when the receiver is mounted within the receiver can 250. The cover assembly 255 is also mated to the audio tube 165 for conducting sound from the receiver's spout.

Figure 3C:
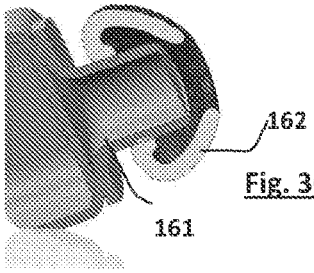

In the embodiment shown by FIGS. 3A-3C, the suspension seal 162 is tulip-shaped and designed to maintain equal pressure in the seal and suspension areas when the receiver 160 is mounted within the receiver can 250 covered by the cover assembly 255. The suspension seal 162 may be designed to be compatible with both short and long receiver spouts. As shown in FIG. 3C, the wrap around tip of the suspension seal 162 may ensure that the spout 161 contacts the suspension seal before the receiver contacts the receiver can in severe shock conditions. FIGS. 4A-4C illustrate how the combination of the suspension seal 162 and cover assembly 255 create a ball and socket type of structure that helps absorb manufacturing tolerances and misalignments in the final assembly.

Figure 5A:
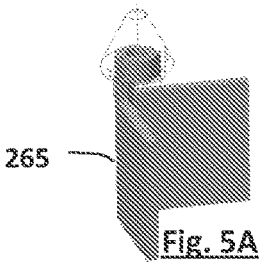
FIGS. 5A through 5C illustrate the use of elastomeric bumpers for suspending the receiver within the receiver can.
Figure 5B:
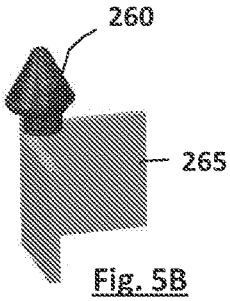
Figure 5C:
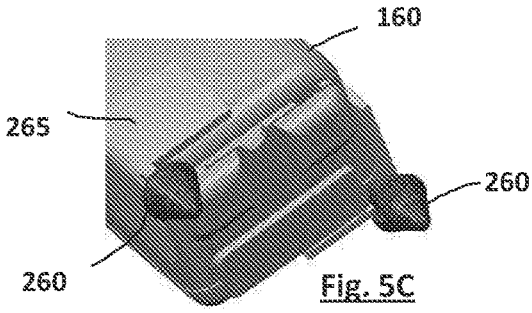

FIGS. 5A through 5C illustrate the use of elastomeric bumpers 260 for suspending the receiver within the receiver can according to one embodiment. The bumpers are mounted at the bottom end of the receiver 160 to suspend the receiver within the receiver can when the receiver is mounted therein. In one embodiment, a metal-formed corner brace 265 is over-molded with an elastomer corner bumper 260 and attached to a bottom corner of the receiver 160. As shown in FIG. 5C, only two bumpers 260 may be required when the bumpers are diagonally placed on the bottom of the receiver. The corner braces 265 may be laser welded or bonded in place.

When the receiver is placed in the receiver can, the bumpers 260 maintain stability while reducing points of contact which could bias the receiver and transmit vibration.

Figure 6D:
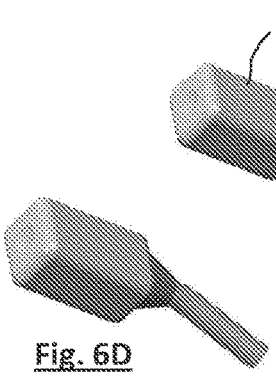
FIGS. 6A through 6D illustrate the assembly process.
Figure 6C:
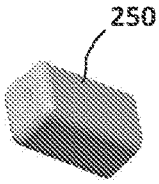
Figure 6C:
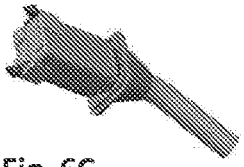
Figure 6B:
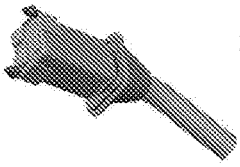
Figure 6A:
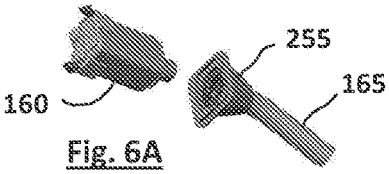
Figure 7:
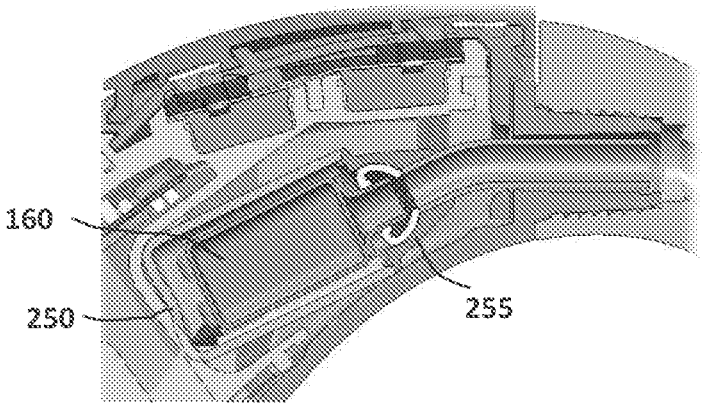
FIG. 7 shows the final assembly within the housing in cross-section.

FIGS. 6A through 6D illustrate the assembly process. Starting with FIG. 6A, the cover assembly 255 is connected to the audio tube 165 with the suspension seal 162 seated therein. FIG. 6B shows the receiver spout 161 next being inserted into the suspension seal 162. FIG. 6C shows the receiver 160 being inserted into the receiver can 250. FIG. 6D shows the final assembly. FIG. 7 shows the final assembly within the housing 201 in cross-section.

Other techniques for suspending a receiver within a receiver may involve the use of custom molded wrap around gaskets and bumpers. These types of designs, however, are generally expensive and difficult to align in manufacture. Placing two square elastomer gaskets on opposite ends of a receiver, sealing around a spout on one of them, and running wires under the front one without creating misalignment or excessive contact with the can is difficult. Even if that is accomplished, there is still a need to insert a rigid seal tube from the outside to lock and seal everything in place. This action can now create a linear compression force on the internal gaskets which also can bias the receiver and or transmit vibration.

In the embodiments described above and illustrated by FIGS. 3A-3C, FIGS. 4A-4C, FIGS. 5A-5C, and FIGS. 6A-6D, the rear suspension uses rigid alignment features (metal) to locate off the sides of the receiver for a repeatable, aligned, low profile attachment. There are only two points of contact with the can versus eight points used in most other assemblies. On average, only half the required open space is required inside the can due to the thin (e.g., 0.005) wall-section of the metal suspension arms. Also, wires do not run under the suspensions. The front suspension ball and socket design of the suspension seal and cover assembly promotes greater seal consistency (radial) while adapting to buildup of manufacturing tolerances. There are fewer opportunities for slit leaks. The over-molded metal tube permits thinner wall section and use of higher gain receivers. The front and rear suspension may also be made universal to allow purchase in bulk and lowering of the piece part cost. The overall spatial requirement for this can in a can assembly may permit industrial designs that are thinner near the ear-hook and lower in profile.

Figure 8A:
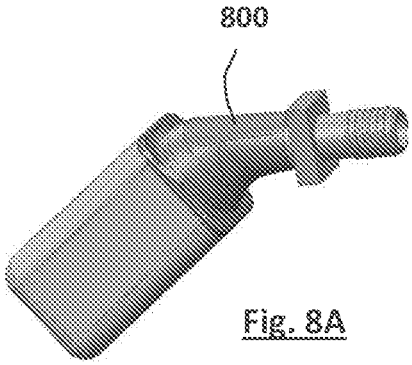
FIGS. 8A-8B show an embodiment using a modular universal suspension assembly with a modified can cover.
Figure 8B:
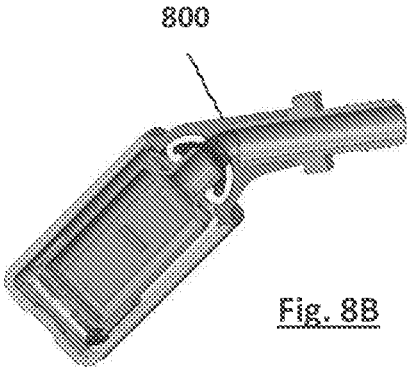
Figure 9:
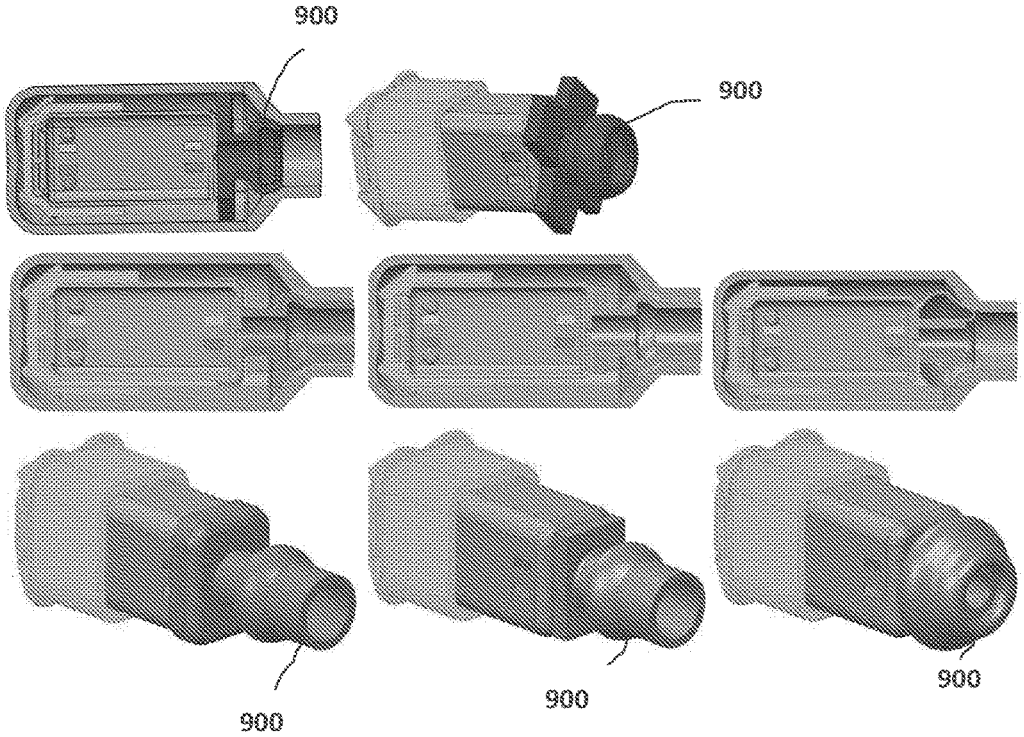
FIG. 9 shows different embodiments that use an elastomeric spout suspension.

Alternative embodiments to those described above include the use of a spine interface to retain the suspensions and isolate the receiver. Another embodiment involves the use of a modular universal suspension assembly with a modified can cover configured to retain and acoustically seal a reduced form ear-hook interface contained entirely inside the device. FIGS. 8A-8B show an embodiment using a modular universal suspension assembly with a modified can cover 800 over-molded or bonded to a universal threaded or interlocking ear-hook interface. FIG. 9 shows different embodiments that use an elastomeric spout suspension 900.

Example Embodiments

In an example embodiment, a hearing aid comprises: an input transducer for converting an audio input into an input signal; a processor for processing the input signal into an output signal in a manner that compensates for a patient's hearing deficit; an audio amplifier, and a receiver for converting the output signal into an audio output, wherein the receiver is contained in a receiver can as described above.

In an example embodiment, a hearing aid comprises: a receiver for converting an electrical signal into an audio output; a receiver can for containing the receiver, wherein receiver can has top and bottom ends with the top end being open; a spout at the top end of the receiver for conducting sound out of the receiver; a cover assembly for covering the open top end of the receiver can and for containing the receiver's spout when the receiver is mounted within the receiver can; and, wherein the cover assembly is mated to an audio tube for conducting sound from the receiver's spout. The hearing aid may further comprise a spout suspension seal surrounding the receiver's spout within the cover assembly. The spout suspension seal may be an annular ring made of elastic material that radially seals a connection between the receiver's spout and the audio tube. The hearing aid may further comprise elastomeric bumpers mounted on the bottom end of the receiver to suspend the receiver within the receiver can when the receiver is mounted therein. The receiver can and receiver may be both generally cuboidal in shape and wherein a pair of elastomeric bumpers are mounted at opposite diagonal corners of the bottom end of the receiver.

Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Such devices may include antenna configurations, which may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device, comprising:

a receiver for converting an electrical signal into an audio output;

a receiver can for containing the receiver, wherein the receiver can has top and bottom ends with the top end being open through which the receiver is inserted into the receiver can;

a spout at the top end of the receiver for conducting sound out of the receiver;

a cover assembly for covering the open top end of the receiver can and for containing the receiver's spout when the receiver is mounted within the receiver can;

wherein the cover assembly has an audio tube mated thereto for conducting sound from the receiver's spout;

a spout suspension seal surrounding the receiver's spout within the cover assembly;

one or more elastomeric bumpers mounted on the bottom end of the receiver; and, wherein the receiver is suspended within the receiver can by the spout suspension seal and the one or more elastomeric bumpers, wherein the spout suspension seal surrounds the spout to absorb shocks when the spout vibrates.

2. The device of claim 1 wherein the spout suspension seal surrounds the spout to absorb shocks when the spout vibrates in a direction along a longitudinal axis of the spout as well as in a direction perpendicular thereto.

3. The device of claim 1 wherein the spout suspension seal surrounds the spout within the cover assembly and has a wrap-around tip extending over the end of the spout.

4. The device of claim 1 wherein the spout suspension seal is an annular ring made of elastic material that radially seals a connection between the receiver's spout and the audio tube.

5. The device of claim 1 wherein the spout suspension seal forms a ball and socket structure.

6. The device of claim 1 wherein the spout suspension seal is tulip-shaped.

7. The device of claim 1 wherein the spout suspension seal is adapted to maintain equal pressure in the area of the suspension seal contacting the cover assembly when the receiver is mounted within the receiver can and covered by the cover assembly.

8. The device of claim 1 wherein the spout suspension seal is adapted to ensure that the spout contacts the spout suspension seal before the receiver contacts the receiver can during mechanical shock conditions.

9. The device of claim 1 wherein the receiver can and receiver are both generally cuboidal in shape and wherein a pair of elastomeric bumpers are mounted at opposite diagonal corners of the bottom end of the receiver.

10. The device of claim 1 further comprising corner braces attached to opposite bottom corners of the receiver.

11. A method for constructing a hearing assistance device, comprising:

suspending a receiver for converting an electrical signal into an audio output in a receiver can, wherein the receiver can has top and bottom ends with the top end being open to allow the receiver to be inserted into the receiver can;

disposing a spout at the top end of the receiver for conducting sound out of the receiver;

placing a cover assembly for covering the open top end of the receiver can and for containing the receiver's spout when the receiver is mounted within the receiver can;

wherein the cover assembly has an audio tube mated thereto for conducting sound from the receiver's spout;

disposing a spout suspension seal surrounding the receiver's spout within the cover assembly;

mounting one or more elastomeric bumpers on the bottom end of the receiver; and, wherein the receiver is suspended within the receiver can by the spout suspension seal and the one or more elastomeric bumpers, and further wherein the spout suspension seal surrounds the spout to absorb shocks when the spout vibrates in a direction along a longitudinal axis of the spout as well as in a direction perpendicular thereto.

12. The method of claim 11, wherein the spout suspension seal surrounds the spout to absorb shocks when the spout vibrates in a direction along a longitudinal axis of the spout as well as in a direction perpendicular thereto.

13. The method of claim 11 wherein the spout suspension seal surrounds the spout within the cover assembly and has a wrap-around tip extending over the end of the spout.

14. The method of claim 11 wherein the spout suspension seal is an annular ring made of elastic material that radially seals a connection between the receiver's spout and the audio tube.

15. The method of claim 11 wherein the spout suspension seal forms a ball and socket structure.

16. The method of claim 11 wherein the spout suspension seal is tulip-shaped.

17. The method of claim 11 wherein the spout suspension seal is adapted to maintain equal pressure in the area of the suspension seal contacting the cover assembly when the receiver is mounted within the receiver can and covered by the cover assembly.

18. The method of claim 11 wherein the spout suspension seal is adapted to ensure that the spout contacts the spout suspension seal before the receiver contacts the receiver can during mechanical shock conditions.

19. The method of claim 11 wherein the receiver can and receiver are both generally cuboidal in shape and further comprising mounting a pair of elastomeric bumpers at opposite diagonal corners of the bottom end of the receiver.

20. The method of claim 11 further comprising attaching corner braces to opposite bottom corners of the receiver.

* * * * *